US005340505A

United States Patent [19]

Hanulik et al.

[11] Patent Number: 5,340,505

[45] Date of Patent: Aug. 23, 1994

[54] METHOD FOR DISSOLVING RADIOACTIVELY CONTAMINATED SURFACES FROM METAL ARTICLES

[75] Inventors: Jozef Hanulik, Zurich; Jean-Francois Equey, St. Prex, both of Switzerland

[73] Assignee: Recytec SA, Switzerland

[21] Appl. No.: 746,027

[22] Filed: Aug. 16, 1991

[30] Foreign Application Priority Data

Oct. 26, 1990 [CH] Switzerland ..... 03429/90

[51] Int. Cl.[5] ..... G21F 9/10; C23G 1/02; C23G 1/14; C23G 1/36

[52] U.S. Cl. ..... 588/18; 134/2; 134/3; 134/10; 134/41; 423/20; 204/1.5

[58] Field of Search ..... 252/626, 631, 632, 628, 252/633; 134/2, 3, 10, 28, 29, 41; 204/1.5; 423/4, 18, 20, 98

[56] References Cited

U.S. PATENT DOCUMENTS

| | | | |
|---|---|---|---|
| 1,899,734 | 2/1933 | Stockton | 134/3 |
| 2,154,451 | 4/1939 | Hull | 134/3 |
| 3,080,323 | 3/1963 | Newman | 252/626 |
| 3,341,304 | 9/1967 | Newby | 423/4 |
| 3,383,183 | 5/1968 | Grant | 423/18 |
| 3,409,413 | 11/1968 | Burns et al. | 423/4 |
| 3,565,707 | 2/1971 | Radimer et al. | 156/625 |
| 3,668,131 | 6/1972 | Banush et al. | 252/79.4 |
| 3,873,362 | 3/1975 | Mihram et al. | 134/3 |
| 3,891,741 | 6/1975 | Carlin et al. | 423/2 |
| 3,965,237 | 6/1976 | Paige | 423/4 |
| 4,086,325 | 4/1978 | Cordier et al. | 423/280 |
| 4,217,192 | 8/1980 | Lerch et al. | 204/149 |
| 4,374,744 | 2/1983 | Kawanabe et al. | 252/79.4 |
| 4,443,269 | 4/1984 | Capella | 134/12 |
| 4,500,449 | 2/1985 | Kuhnke et al. | 252/628 |
| 4,530,723 | 7/1985 | Smeltzer et al. | 106/90 |
| 4,537,666 | 8/1985 | Murray et al. | 204/129.95 |
| 4,620,947 | 11/1986 | Carlson | 252/628 |
| 4,686,019 | 8/1987 | Ryan et al. | 204/1.5 |
| 4,701,246 | 10/1987 | Fujita et al. | 204/130 |
| 4,828,759 | 5/1989 | Hanulik | 252/628 |
| 4,933,113 | 6/1990 | Hanulik | 252/628 |
| 4,992,149 | 2/1991 | Nguyen | 204/96 |
| 5,008,044 | 4/1991 | Hanulik | 252/628 |
| 5,035,749 | 7/1991 | Haruta et al. | 134/2 |
| 5,084,253 | 1/1992 | Pollock et al. | 423/65 |

FOREIGN PATENT DOCUMENTS

| | | |
|---|---|---|
| 0073366 | 9/1981 | European Pat. Off. . |
| 2058766 | 5/1972 | Fed. Rep. of Germany . |
| 2421313 | 11/1974 | Fed. Rep. of Germany . |
| 2714245 | 4/1980 | Fed. Rep. of Germany . |
| 2333331 | 11/1975 | France . |
| 2067500 | 3/1987 | Japan . |
| 0398702 | 2/1974 | U.S.S.R. . |
| 891760 | 3/1962 | United Kingdom . |

OTHER PUBLICATIONS

Hall, Nathaniel et al. "Stripping Metallic Coatings." Metal Finishing Guidebook and Directory. vol. 78: No. 1a Mid-Jan., 1980: 505.

Dekontamination eines Reaktor-Kuhlwasserkreislaufs am Beispiel des Forschungsreaktors WWR-S in Rossendorf: H. Unger and D. Westphal, Kernenergie, pp. 285-290, Dec. 11, 1968.

*Primary Examiner*—Donald P. Walsh
*Assistant Examiner*—Ngoclan T. Mai
*Attorney, Agent, or Firm*—Speckman, Pauley & Fejer

[57] ABSTRACT

A method for dissolving radioactively contaminated surfaces of metal articles using a reagent of $HBF_4$ acid with the addition of at least one oxidation agent, preferably hydrogen peroxide $H_2O_2$, for the efficient decontamination of radioactively contaminated metal articles. An optimum mixture of this reagent was about 5% $HBF_4$ acid with the addition of about 0.5% by volume of $H_2O_2$. Radioactively contaminated lead plates, for example, were treated by this reagent, and the contaminated solution was used as an electrolyte without any further additive. The contaminated lead or lead oxide is deposited at the anode or cathode decontaminating the solution which may be returned to the process. If, instead of lead, the metal is copper, nickel, steel, silver or mercury or their alloys, the method for dissolving radioactively contaminated surfaces can be executed in the same way with the same reagent.

22 Claims, 4 Drawing Sheets

METHOD FOR DISSOLVING RADIOACTIVELY CONTAMINATED SURFACES FROM METAL ARTICLES

BACKGROUND OF THE INVENTION

1. Field of the Invention

The present invention relates to a method for dissolving oxidized or non-oxidized radioactively contaminated surfaces from metal articles.

Articles of lead or lead-containing alloys are used in nuclear workplaces for shielding against radioactive radiation. It is known that a lead plate of an approximate thickness of 5 cm reduces radioactive radiation by a factor of 10. For this reason, shielding blocks are made of lead or lead alloys which are used to build entire walls around highly radioactive components. Pipes emitting strong radioactive radiation are shielded with lead mats. It is of course possible for these shielding blocks, lead mats and lead plates to become radioactively contaminated. Therefore, they must be decontaminated from time to time. Up to now this has not been done in a satisfactory manner. The surfaces of the lead or the lead-containing articles were scraped off or brushed by hand, the scraped off, contaminated material decontaminated and the remaining articles, still slightly radioactive, were melted down. The result was unsatisfactory and additionally resulted in spread of the radioactivity. Although the reclaimed articles of lead or lead-containing alloys could be reused, they exhibited increased radioactivity from the start. A second variant consisted of providing the lead shielding blocks or plates with a plastic covering, which was replaced from time to time. The contaminated plastic covering was decontaminated each time. Both variants resulted in a relatively large amount of waste which had to be decontaminated.

Lead articles are used in various nuclear applications. For example, in nuclear armaments, where lead components are used as reflector shields, among other uses, it is necessary to renew these lead components from time to time in order to maintain the operational readiness of the nuclear arms and to decontaminate the lead waste.

The same problems appearing in connection with lead and lead alloys are relevant in connection with other metals. For example, in installations for manufacturing $UF_6$ in the civilian and military sectors there are large amounts of radioactively contaminated nickel. Although the value of these metals is high, only the smallest amounts could be reclaimed for reuse. An installation for manufacturing $UF_6$ contains approximately 1,000 to 10,000 tons (metric) of pure nickel. Also, heat exchangers and steam generating installations of pressurized water reactors contain large amounts of nickel based alloys, such as Inocel 600 with a Ni content of approximately 70%. Both Cu and Cu alloys are also employed in heat exchangers and condensers of nuclear installations.

2. Description of the Prior Art

A method for the decontamination of radioactively contaminated metallic materials is known from U.S. Pat. No. 4,828,759. The radioactively contaminated metallic articles are placed into a bath containing fluoboric acid, which may be electro-chemically regenerated and the metals recovered and the regenerated fluoboric acid returned to the process. This method has proven too time-consuming for the decontamination of articles of lead and lead-containing alloys and, furthermore, is only usable at higher temperatures and concentrations. Solubility of lead and other metals, such as Ni, Cu, Hg, Ag or steel is a very slow process at room temperature even in $HBF_4$ acid and it additionally generates hydrogen while taking place.

A possibility for removing lead contamination from copper alloys and steel is described in the publication "Metal Finishing Guidebook and Directory", Vol. 78, No. 1a, January 1980, page 505. Fluoboric acid and 30% hydrogen peroxide is recommended there for cleaning. Accordingly, it is intended to take off a thin layer of lead in cleaning of this type, while the underlying layer of different metals should not be altered, if possible. However, in the beginning of the above mentioned publication the recommendation for the use of hydrogen peroxide is qualified, since destruction of the surface may result. However, decontamination of radioactively contaminated lead is based on completely solid lead and the depth of removal as great as necessary.

SUMMARY OF THE INVENTION

It is therefore the object of the present invention to provide a method which is particularly suitable for dissolution of oxidized or non-oxidized radioactively contaminated surfaces from metallic articles and which considerably speeds up the process in contrast to known methods and which can be executed at room temperature. This object is attained by contacting oxidized or non-oxidized radioactively contaminated surfaces of metal articles with a decontamination agent comprising fluoboric said $HBF_4$ at a concentration of less than about 80 percent and at least one oxidation agent. In preferred embodiments, the reagent comprises aqueous fluoboric acid $HBF_4$ in concentrations of less than about 50 percent, and most preferably, less than 10 percent. The oxidation agent should be present in amounts of less than about 20 percent by volume, and preferably, less than about 5 percent by volume. A preferred oxidation agent is hydrogen peroxide in an amount of less than about 2 volume percent. Mixtures of oxidation agents may be used, a preferred mixture being about 0.5 to about 2 percent by volume hydrogen peroxide and about 0.1 to about 2 percent potassium permanganate. Excellent results in dissolution of lead from radioactively contaminated metal surfaces have been achieved with an aqueous solution of about 5 to 20 percent fluoboric acid and about 0.5 to 2 percent by volume of hydrogen peroxide.

BRIEF DESCRIPTION OF THE DRAWING

The explanation of the effect of the reagent in accordance with the invention ensues in the following description and by reference to the drawing, wherein.

DESCRIPTION OF PREFERRED EMBODIMENTS

Figure 1B:
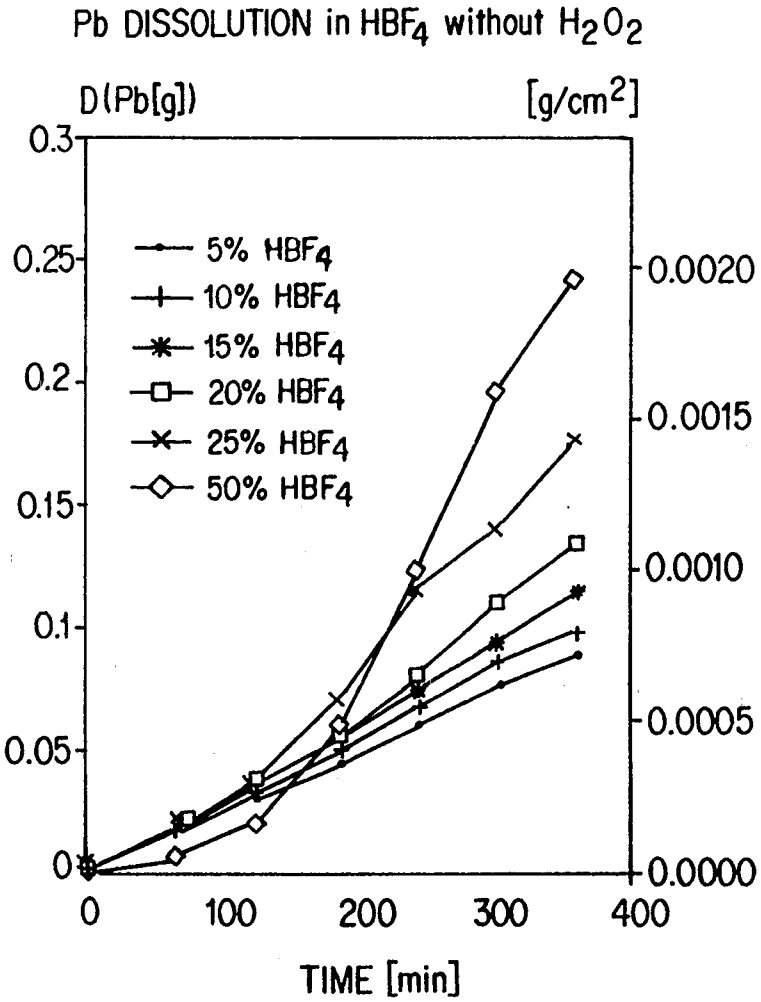
FIGS. 1A and 1B show the weight loss of a lead plate at various $HBF_4$ concentrations as a function of the time A) with the addition of 0.5% by volume of $H_2O_2$ and B) without the addition of $H_2O_2$.
Figure 1A:
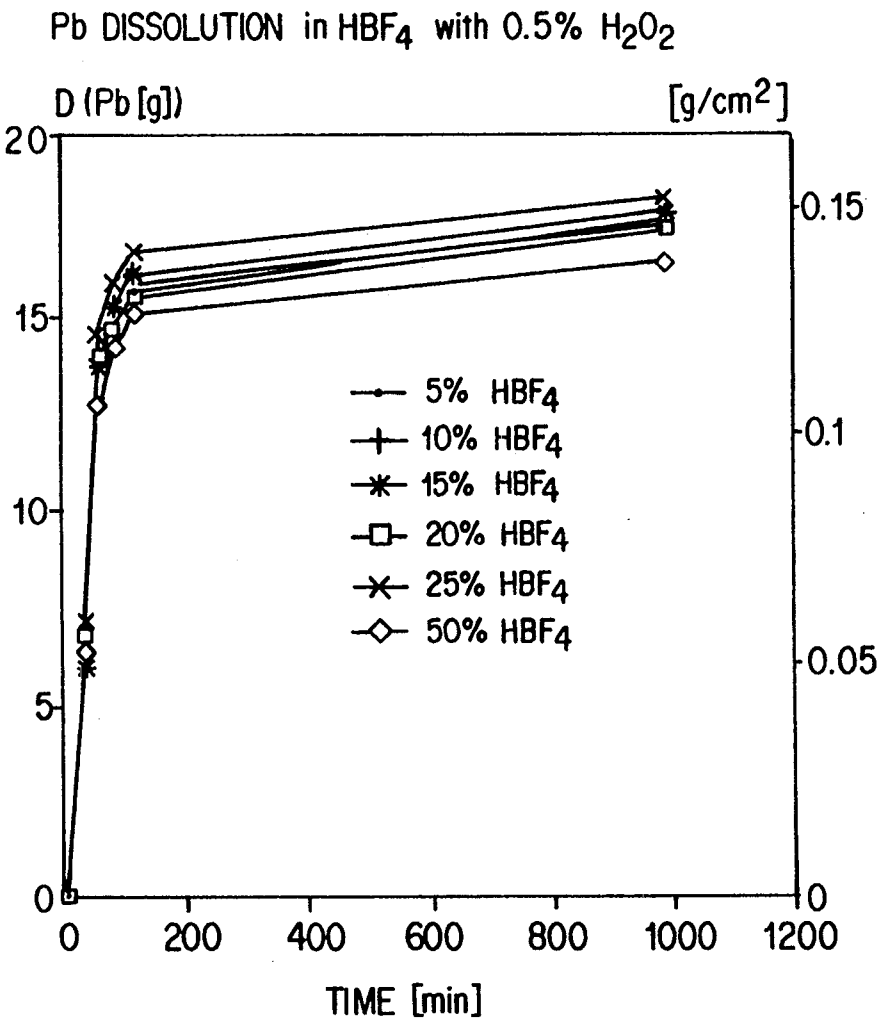

A lead plate of a thickness of 0.25 mm and with an area of $2\times88$ cm$^2$ was used in the performance of the experiments described below. To remove any covering of the lead plate with a protective film of grease, it was degreased with acetone prior to insertion into the treating solution. Each use of fluoboric acid $HBF_4$ was based on 50% pure acid and the various degrees of dilution were obtained by adding de-ionized water. The lead plate was weighed before and after each treatment. In a first test run the weight loss of a standardized lead plate of the above mentioned type in various $HBF_4$ concentrations was determined as a function of time. This resulted in the graphs shown in FIG. 1B. Using $HBF_4$ acid without added $H_2O_2$, there were very small relevant differences after 200 minutes in the various concentrations between 5 and 50%. Different weight loss of the lead plates was shown only after approximately 400 minutes, where lead plates subjected to $HBF_4$ acid at higher concentrations showed greater lead losses. After approximately 200 minutes the weight loss per plate at all concentrations of $HBF_4$ acid was approximately 0.05 grams. Similar tests were repeated with the addition of 0.5% by volume of $H_2O_2$, again as a function of various concentrations of $HBF_4$ acid. The new graphs shown in FIG. 1A indicate a greatly improved dissolution of lead from the plates.

A weight loss of approximately 15 grams was measured after approximately 100 minutes on all plates, regardless of the concentration of $HBF_4$ acid. Accordingly it was shown that the dissolution of lead had been increased by a factor of 300 within half the time. In contrast to the tests without the addition of hydrogen peroxide, it was shown that the increase in the concentration of $HBF_4$ acid above 5% did not obtain an improvement in the results. Accordingly, it was shown that the decomposition of the oxide layer took place immediately and the dissolution of lead started quickly because of the addition of 0.5% by volume of $H_2O_2$. Initially dissolution was fast and afterwards slowed. Dissolution ceased once a concentration of 55 grams of lead per liter had been attained.

Analogous observations have been shown following tests with Ni, Cu, Ag, Hg and steel. Subsequently the tests, so far made at room temperature, were repeated at a temperature of 60° C. Here, again, it was shown, that the decomposition rate steeply increased as a result of the addition of 0.5% of $H_2O_2$, however, no increase in lead dissolution over the performance of tests at room temperature was noted.

| Metal | Dissolution Kinetics in [mg/cm$^2$h] |
|---|---|
| Ag | approx. 1.0 |
| Cu | 1.0 |
| Hg | 0.8 |
| Ni | 3.0 |
| Inocel 600 | 0.5 |

These data refer to a reagent of 5% $HBF_4$ with 0.5% $H_2O_2$ at a temperature of 25° C.

Figure 2A:
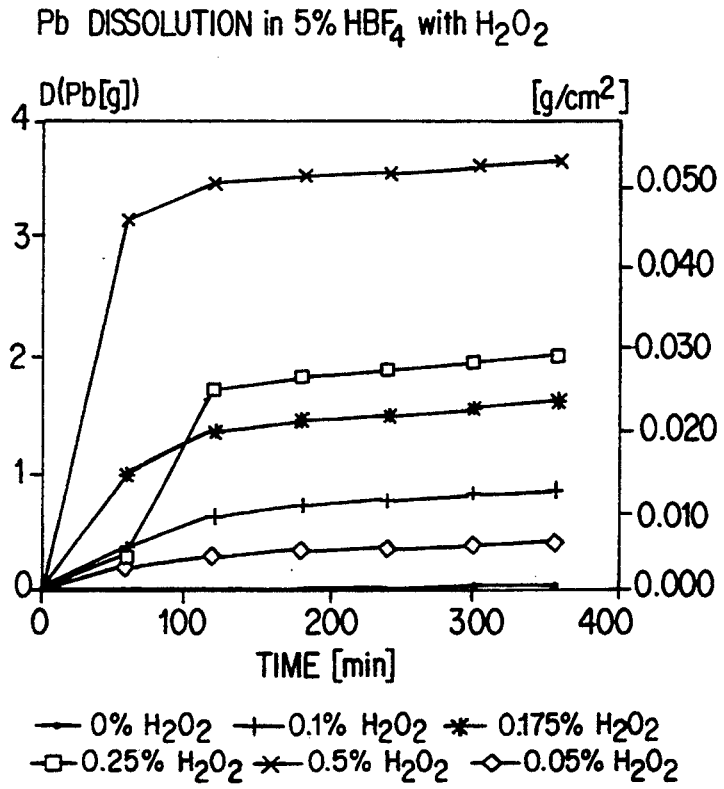
FIGS. 2A and 2B again show the weight loss of a lead plate in 5% $HBF_4$ with various concentrations of $H_2O_2$.
Figure 2B:
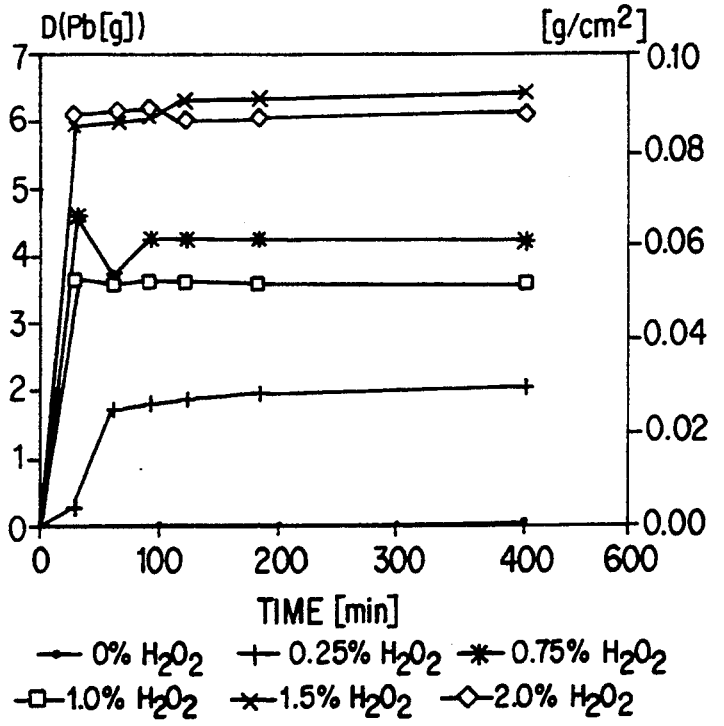

Thus, the result of the work up to here is that an optimum result is achieved with 5% $HBF_4$ acid. Now, the rate of solubility of lead in 5% $HBF_4$ acid was determined as a function of the concentration of hydrogen peroxide contained therein. FIGS. 2A and B show the result. With increasing $H_2O_2$ concentration a steady increase of the speed of dissolution of the lead was noted, this within a range from 0.05 to 2% by volume.

In every case lead dissolution was initially fast and slowed after 60 minutes. With hydrogen peroxide concentrations between 0.5 and 1.0%, the solution attained a maximum lead concentration of 80 grams per liter towards the end of the process. At this concentration a white sediment formed in the solution and on the surface of the lead. At higher concentrations of $H_2O_2$ the dissolution reaction was strongly exothermic. Using the test arrangement with 50 milliliters of solution, the latter started to boil immediately and a white sediment formed almost simultaneously in the solution. The maximum lead concentration in a 10% $HBF_4$ solution leveled out at approximately 120 grams per liter. Although this concentration is greater by approximately 50% than in the previously measured cases, such dissolution conditions are unacceptable in a process on the industrial scale.

The result of all of the work described was that the preferred reagent for dissolving the surfaces of oxidized or non-oxidized lead plates takes place most advantageously in a solution of about 5% $HBF_4$ acid and about 0.5% by volume of hydrogen peroxide. The work in connection with the process for the decontamination of radioactively contaminated articles of lead or lead-containing alloys was performed using this solution.

A few tests to replace hydrogen peroxide by other oxidation agents have also resulted in useful solutions. Tests using permanganate-$HBF_4$ solutions have also shown acceptable results. The best results were, surprisingly, achieved with a combination of different oxidation agents, together with 5% fluoboric acid. In particular, a mixture where 0.5 to 2% by volume of hydrogen peroxide and 0.1 to 2% of potassium permanganate were added to 5% fluoboric acid, resulted in considerable increase in the values shown in the above table regarding dissolution kinetics. The oxidation agent, potassium permanganate $KMnO_4$, oxidizes the metals or their oxides and transforms them into a form which is particularly readily dissolvable in the acid. Such a solution of metals and metal oxides containing radioactivity is, for example:

$$MnO_4^- + 2H_2O + 3e^- \rightarrow MnO_2 + 4OH^-$$

In contrast to the known AP-Citrox decontamination process, no manganese dioxide $MnO_2$ is deposited on the surface of the metal.

Figure 3:
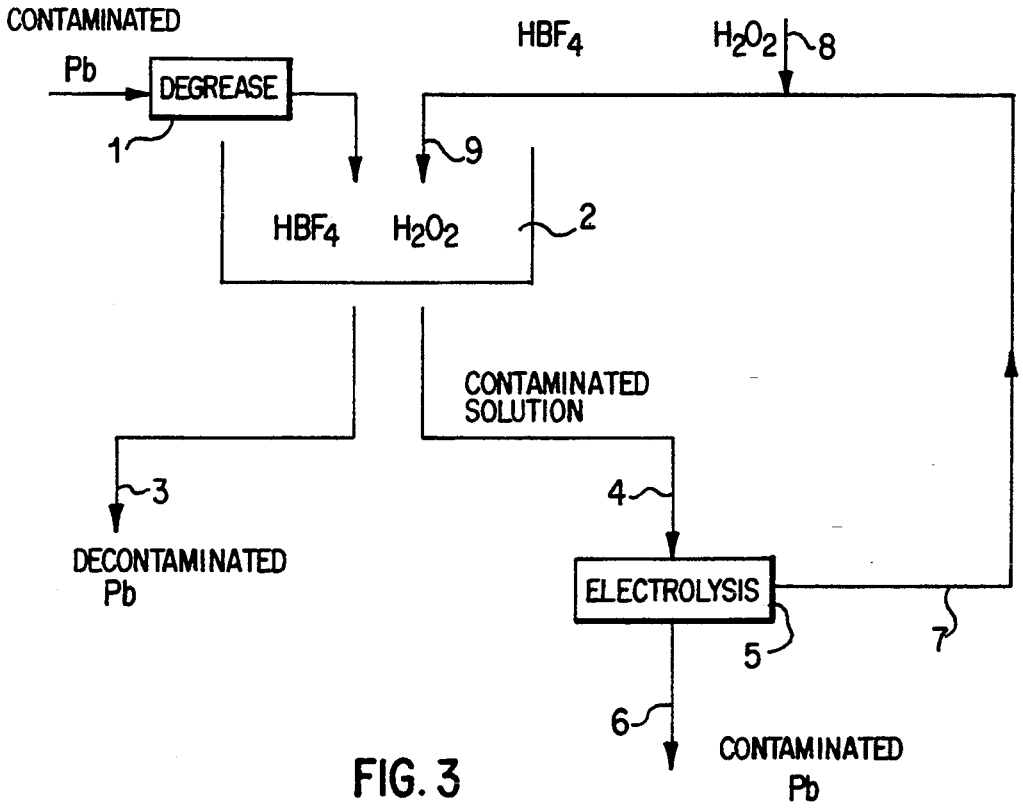
FIG. 3 is a schematic flow diagram of the process of the invention.
Figure 4:
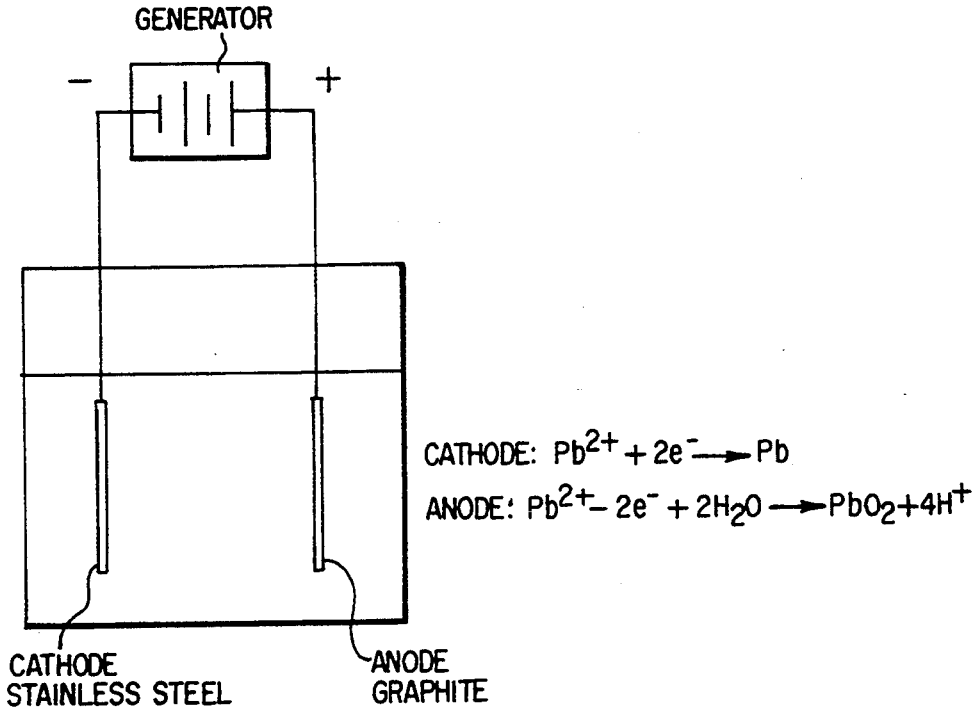
FIG. 4 shows the apparatus for the electrolysis cell and reagent equations.

The contaminated articles must be degreased in a first step (1), as shown in FIG. 3. They are placed in a solution bath (2) thereafter. This already contains the described reagent, 5% $HBF_4$ acid and 0.5% by volume hydrogen peroxide. After the reagent has been allowed to act on the lead plates for approximately 60 minutes, depending on the required removal depth, and the now decontaminated lead plates are removed (3) from the solution bath (2). The solution, which is now contaminated, is passed (4) to an electrolysis bath, for performing electrolysis (5). The contaminated lead or lead oxide is now deposited on the anode or cathode. The concentrated, radioactively contaminated material (6) is now present in a highly concentrated form and nuclear disposal in a known manner is now possible. The remaining $HBF_4$ acid is taken from the electrolysis cell by stream (7) and recycled by stream (9) to solution bath (2). This is done with the addition (8) of $H_2O_2$ until the desired concentration has again been attained. When all articles have been decontaminated, the process can be stopped by neutralizing the acid after electrolysis has been performed by the addition of potassium hydroxide or by regenerating it in a cationic ion exchanger into a pure, non-contaminated acid. A sediment is formed in a known manner in the course of this, which can be filtered out or sedimented. The remaining, contaminated filter cake can be solidified and nuclear disposal in a known manner is now possible. The remaining filtrate is free of activity and also no longer contains lead. It can therefore be disposed of without any additional precautions, for example by placing it in the sewage disposal system.

In further test runs it was determined under what conditions the electrolysis of the 5% $HBF_4$ acid should be performed in order to obtain as efficient as possible a precipitation of the lead or lead oxide. The tests were performed at room temperature and with the use of stainless steel at the cathode and with a graphite anode. The electrolyte consisted of 5% $HBF_4$ acid with a $Pb^{2+}$ content of approximately 30 grams per liter. The electrolyte was prepared by dissolving lead in 5% $HBF_4$ acid with a 0.5% $H_2O_2$ content by volume. The initial pH value was approximately 0. Lead electrolysis was started at a potential of approximately 2.0 Volts. Bubbles were initially formed on the anode surface. They disappeared as soon as lead oxide had been formed.

Figure 5A:
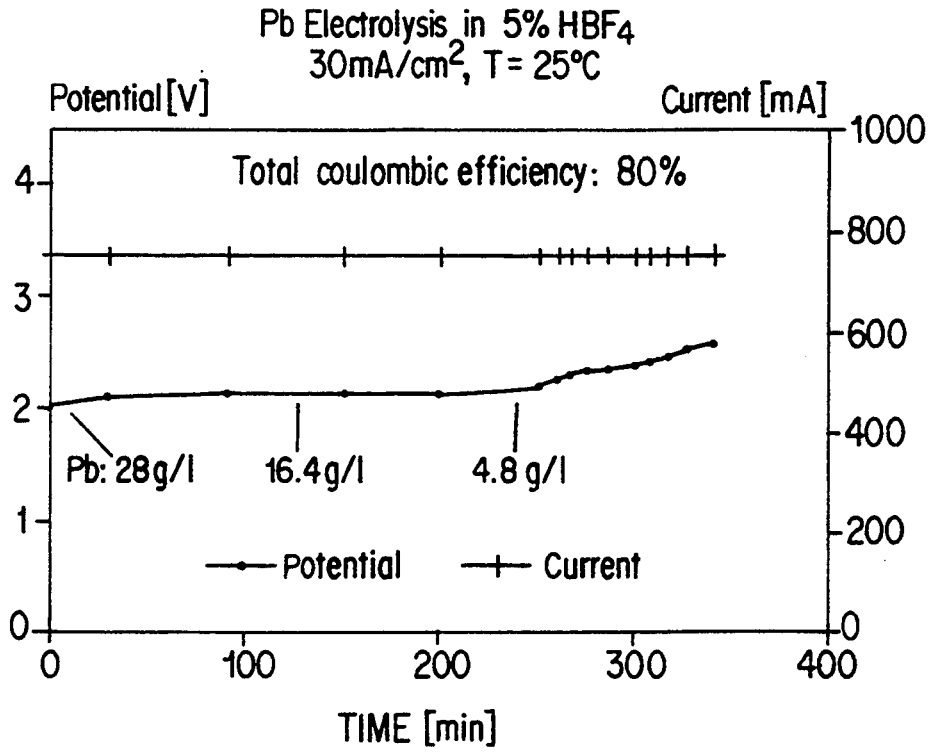
FIG. 5A and 5B show the course of the electrolysis performed as a function of the current density, namely A at 30 $mA/cm^2$ and B at 45 $mA/cm^2$.
Figure 5B:
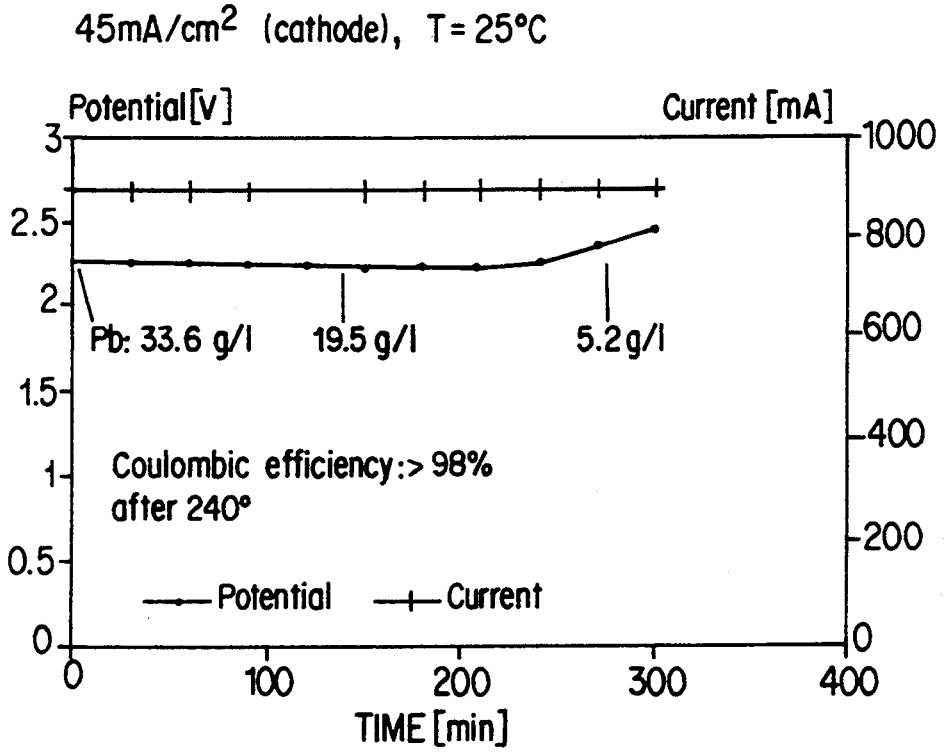

During electrolysis the voltage remained stable with a current density of 30 as well as 45 milli-Ampere per $cm^2$, until the lead concentration was approximately 5 grams per liter. Starting at this point, the voltage began to increase, while simultaneously bubble formation could be seen, particularly on the anode, accompanied by a rapid deterioration of the coulombic efficiency. With a density of the electrolysis current of 30 mA per $cm^2$, the coulombic efficiency was a little more than 80%, while with an increase of the current density to 45 mA per $cm^2$ the coulombic efficiency was nearly 100%. The coulombic efficiency depends upon whether it is calculated before or after the moment of voltage increase. FIGS. 5A and 5B show two examples of lead electrolysis. In both cases the current was maintained at a fixed value. It was noted that the voltage remained stable as long as the lead concentration was below 5 to 6 grams per liter. As soon as this concentration had been achieved, the voltage began to increase and the coulombic efficiency decreased. An increase in the voltage also led to the formation of oxygen bubbles on the surface of the anode. It therefore seems advantageous to perform electrolysis while controlling the voltage in order to prevent the formation of oxygen.

It follows from the tests that the dissolution of metallic lead in $HBF_4$ acid of less than 50% with a content of less than 2% by volume of $H_2O_2$ caused considerably improved dissolution. Particularly good results were obtained with 5% $HBF_4$ acid with a content of 0.5% $H_2O_2$ by volume. It was possible to dissolve in this solution 35 grams of lead per liter in approximately 90 to 120 minutes. Following the dissolution of the lead, the solution was used without any additional modification directly as an electrolyte for the recovery of lead. Electrolysis resulted in homogenous lead at the steel cathode and, correspondingly, in lead dioxide $PbO_2$ at the graphite anode. Coulombic efficiency was more than 90% as long as the electrolysis voltage was maintained at a potential where there was almost no $O_2$ formed.

Various additional methods of use can be realized when a reagent is used which comprises a mixture of 5% $HBF_4$ as well as 0.5 to 2% by volume $H_2O_2$ and 0.1 to 2% $KMnO_2$. Since with use of this reagent nothing but water-soluble components accumulate, the decontaminated articles can be simply rinsed clean with water at the end.

With the high speed of dissolution it has also been shown, that this reagent can also be pumped directly into a closed pipe system, for example the heat exchanger of a nuclear power plant, recirculated in it for a number of hours and subsequently pumped out in the form of a radioactive reagent and electrolytically regenerated. Since the solution is wholly water-soluble, the pipe system can subsequently by rinsed with water.

An alternative to this is that the reagent is kept in the pipe system, and then passed through an ion exchanger after some time, by means of which all radioactive portions can be removed from the system. Regeneration by means of an ion exchanger is a known technology, which need not be further discussed here.

A possible alternative comprises first exposing the articles to be decontaminated to an oxidizing agent and only then placing them into a pure $HBF_4$ acid bath or spraying them with $HBF_4$ acid. This operation can be repeated several times until the metal surface to be decontaminated shows radioactivity below the easily measured limits.

Finally, it is also possible to perform the first oxidation with the aid of an oxidizing agent and only after this to execute the method already previously described and to place the metal articles which are to be radioactively decontaminated into a reagent of $HBF_4$ and an oxidizing agent.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. In a method for dissolving radioactively contaminated surfaces of articles made of metal, according to which the articles to be decontaminated are contacted with a decontamination agent comprising fluoboric acid in an aqueous solution with a strength of about 0.05 to about 50 mol/liter and where the surfaces of said contaminated articles are dissolved by said decontamination agent, the improvement comprising: changing said radioactively contaminated surfaces into an oxidized state providing an increased and quicker solubility of said radioactively contaminated surfaces in fluoboric acid by contacting said radioactively contaminated surfaces with a single aqueous solution of an oxidizing agent containing less than about 20 percent by volume and said fluoboric acid.

2. A method in accordance with claim 1, wherein hydrogen peroxide is used as said oxidation agent.

3. A method in accordance with claim 2, wherein hydrogen peroxide in a concentration of less than 20 percent by volume is used as said oxidation agent.

4. A method in accordance with claim 1, wherein a mixture of hydrogen peroxide and an additional oxidation agent is used as said oxidation agent.

5. A method in accordance with claim 1, wherein said surfaces of said radioactively contaminated metal articles are contacted with said single aqueous solution comprising fluoboric acid at about 5% concentration and about 0.5% by volume, based upon said single aqueous solution, of hydrogen peroxide.

6. A method in accordance with claim 4, wherein said surfaces of said radioactively contaminated metal articles are contacted with said single aqueous solution comprising fluoroboric acid at about 5% concentration, about 0.5% to about 2%, by volume based upon said single aqueous solution, hydrogen peroxide and about 0.1 to 2%, by volume based upon said single aqueous solution, potassium permanganate.

7. A method in accordance with claim 1, wherein said surfaces of said radioactively contaminated metal are first degreased.

8. A method in accordance with claim 1, wherein said surfaces of said radioactively contaminated metal articles are dissolved in a bath comprising fluoboric acid and said oxidation agent at about room temperature.

9. A method in accordance with claim 8, further comprising electrolytically regenerating a contaminated mixture of dissolved metal, fluoboric acid and oxidation agent at a temperature of about 25° C. at a current density of about 5 to about 500 $mA/cm^2$.

10. A method in accordance with claim 9, wherein said electrolytically regenerating of said contaminated mixture is performed below the voltage leading to the generation of oxygen.

11. A method in accordance with claim 8, wherein said electrolytically regenerating of said contaminated mixture is performed until its metal content is less than about 0.1 g per liter, after which remaining fluoboric acid is reused for repeating the process.

12. A method in accordance with claim 8, wherein following the performance of said electrolytically regenerating said bath is neutralized with addition of calcium hydroxide, sedimentation is filtered and/or sedimented forming a contaminated filter cake, said contaminated filter cake is solidified and decontaminated, and remaining filtrate, free of radioactivity and of metal, is placed into a sewage disposal system.

13. A method in accordance with claim 8, wherein said electrolytically regenerating of said contaminated mixture is performed until its lead content is less than about 0.1 g per liter, after which this solution, which still contains radioactivity, is fed through a cation exchanger, by means of which fluoboric acid free of radioactivity and lead is obtained.

14. A method in accordance with claim 6, wherein the decontaminated metal articles are cleaned by flushing with water.

15. A method in accordance with claim 6 for decontamination of radioactively contaminated closed pipe systems of metal, wherein said single aqueous solution is pumped into the pipe system, recirculated for a time, and finally conducted through an ion exchanger.

16. A method in accordance with claim 6 for decontamination of radioactively contaminated closed pipe systems of metal, wherein said single aqueous solution is pumped into the pipe system and is recirculated for a time, after which contaminated solution is pumped out and the pipe system is rinsed with water.

17. A method in accordance with claim 16, wherein the pumped out solution is electrolytically regenerated.

18. A method for dissolving radioactively contaminated metallic surfaces, comprising: contacting said surfaces with an aqueous solution comprising fluoboric acid at about 5 to 20 percent concentration and an oxidation agent.

19. A method according to claim 18, wherein said oxidation agent comprises about 0.05 to about 2 volume percent, based upon said aqueous solution, hydrogen peroxide.

20. A method according to claim 19, wherein said oxidation agent further comprises about 0.1 to about 2 percent, based upon said aqueous solution, potassium permanganate.

21. A method according to claim 19, wherein said metallic surfaces comprise lead and said contacting ceases prior to said solution attaining a lead concentration of about 55 grams lead per liter.

22. A method according to claim 19, wherein said metallic surfaces comprise lead and said contacting is continued for about 50 to about 150 minutes.

* * * * *